US005983986A

United States Patent [19]

Macintyre et al.

[11] Patent Number: 5,983,986

[45] Date of Patent: Nov. 16, 1999

[54] REGENERATIVE BED HEAT EXCHANGER AND VALVE THEREFOR

[76] Inventors: Kenneth Reid Macintyre, 13 Burnet Street, Oakville; Robert Gene Bamsey, 11 Bannisdale Way., Carlisle, both of Canada, L0R 1H2

[21] Appl. No.: 08/706,286

[22] Filed: Sep. 4, 1996

[51] Int. Cl.[6] ..... F23L 15/02

[52] U.S. Cl. ..... 165/9; 165/54; 165/4; 137/311

[58] Field of Search ..... 165/4, 10, 7, 66, 165/61, 54; 137/309, 310, 311

[56] References Cited

U.S. PATENT DOCUMENTS

| | | | |
|---|---|---|---|
| 2,910,284 | 10/1959 | Wittler | 137/311 X |
| 4,834,285 | 5/1989 | Besik | 237/48 |
| 4,909,307 | 3/1990 | Besik | 164/4 |
| 4,952,283 | 1/1990 | Besik | 165/4 |
| 4,982,575 | 1/1991 | Besik | 62/271 |
| 5,394,860 | 3/1995 | Borle | 126/110 |
| 5,445,213 | 8/1995 | Im | 165/10 |
| 5,515,909 | 5/1996 | Tanaka | 165/10 X |
| 5,540,584 | 7/1996 | Greco | 137/309 X |

FOREIGN PATENT DOCUMENTS 1289117 9/1991 Canada .

1289128 9/1991 Canada .

*Primary Examiner*—Christopher Atkinson

*Attorney, Agent, or Firm*—Dimock Stratton Clarizio; Mark B. Eisen

[57] ABSTRACT

The invention provides a forced air furnace integrated with a ventilator having a pair of regenerative bed heat exchangers. The heat exchangers alternate between heat recovery and heat release modes such that when one heat exchanger is in the heat release mode the other is in the heat recovery mode. A pair of valve members are fixed on a common shaft to control the alternate switching of recovery and release modes between the two heat exchange beds. The valve members are mounted adjacent to inlet and outlet partitions containing the inlet and outlet ports, respectively, in communication with the heat exchange compartments, and are provided with valve openings which, by rotating the shaft, are brought into alignment with the inlet and outlet ports to direct the fresh and stale air streams through the heat exchange beds. Heating and ventilating functions are integrated by providing a damper upstream of the ventilator fresh air outlet to the furnace supply elbow, biased by gravity to a closed position such that the force of air from the furnace air blower is sufficient to open the damper.

26 Claims, 11 Drawing Sheets

20
32
27
36
28
206
40
208
200
202
201
203
50a
50b
230
220
190
186
188

20
32
27
36
206
28
220
230
190
40
208
50a
50b
186
185
188
200
201
202
203

REGENERATIVE BED HEAT EXCHANGER AND VALVE THEREFOR

FIELD OF THE INVENTION

This invention relates to a regenerative bed heat exchanger for a heating and ventilating system for use in a building. In particular, this invention relates to an improved regenerative bed heat exchanger which alternates the recovery and release of sensible heat and moisture between a pair of regenerative heat exchange beds.

BACKGROUND OF THE INVENTION

New standards and techniques of energy efficient building design have been developed in recent years in response to the increasing awareness of government, builders and consumers to the need for energy conservation. Fuel costs and resource-depletion concerns are two major driving factors toward energy efficient building design, and many regions have adopted stringent energy efficiency standards covering such areas as thermal insulation, water heating, space heating and ventilation and controlled air management.

Initial designs which promoted air-tightness of a building have been augmented by designs which focus on efficient usage of energy with a controlled exchange of stale indoor air and fresh outdoor air, in recognition of the potential health problems and structural damage which can result from a poorly ventilated environment. It is thus advantageous to integrate heating and ventilating functions, to achieve the most efficient usage of heating fuels while ensuring proper ventilation of the building for health and structural purposes.

An example of an integrated heater-ventilator is described and illustrated in U.S. Pat. No. 4,909,307 to Besik, which is incorporated herein by reference. The heater-ventilator has a heat exchange unit containing two regenerative heat exchange beds in isolated compartments. Air inlet to and exhaust from the compartments is controlled so that when one heat exchange bed is releasing sensible heat and moisture into the building air supply, the other heat exchange bed is recovering heat and moisture from the return air supply. The air flow through each heat exchange compartment is periodically reversed, so that the release and recovery functions alternate between the two heat exchange beds. This provides the advantage of preventing frost buildup in the heat exchange beds, which can significantly reduce sensible heat recovery efficiency, and allows the ventilator to be active whenever fresh air is required without being limited by the thermal state of the heat exchange bed. This configuration also facilitates moisture control, allowing for recovery of moisture in winter, during which the heat exchange beds retain moisture from the exhaust air stream and return it to the supply air stream when the air flow through the bed is reversed, and in summer effectively removing moisture from outdoor air before it is introduced into the dwelling, thus reducing the load on an air conditioning system.

The regenerative bed heat exchanger of U.S. Pat. No. 4,909,307 utilizes a pair of four-way shuttle valves comprising axially movable rods bearing dampers, housed in a valve compartment with a series of partitions, to control the alternate switching of recovery and release modes between the two heat exchange beds. This system presents certain disadvantages.

First, both valves must be actuated simultaneously in order to ensure that at all times at least one heat exchange bed is in the recovery mode and the other heat exchange bed is in the release mode. This requires adjoining valve rods creating a mechanical connection between the two valves, which complicates their construction and increases the size of the valve drive system.

Second, when the dampers are at intermediate points in the switching cycle they are remote from the inlet and outlet partitions, so there is a direct fluid communication between the stale air stream entering the heat exchange compartment and the fresh air stream being exhausted from the heat exchange compartment. This not only reduces the efficiency of the heat exchanger, it effectively restricts the stale air stream to clean air sources, such as the return air supply from the building, which will not release noxious fumes into the fresh air stream during switch-over intervals. This precludes the recovery of heat from other stale air sources such as bathroom and kitchen ventilators and combustion gas discharge, which can be a valuable sources of sensible heat.

Another disadvantage to this system is that the low energy blower in the heat exchange compartment cannot be active when the high energy furnace blower is inactive, as this would result in backflow from the heat exchange unit into the furnace. Thus, in order to ventilate the building during a period when the furnace is not active because there is no call for heat, both the heat exchange blower and the furnace blower must be activated. This results in unnecessary electrical energy consumption and, in most cases, unnecessarily high flow rates during any furnace-off/ventilator-on interval.

The present invention overcomes these disadvantages by providing valve means comprising a pair of valve members, in the preferred embodiment plastic discs, fixed on a common shaft to control the alternate switching of recovery and release modes between the two heat exchange beds. The valve members are mounted adjacent to inlet and outlet partitions containing the inlet and outlet ports, respectively, in communication with the heat exchange compartments. The valve members are provided with valve openings which, by rotating the shaft, are brought into alignment with the inlet and outlet ports to direct the fresh and stale air streams through the heat exchange beds. Because their rotational motion allows the valve members to remain in constant contact with the inlet and outlet partitions, even during switch-over cycles, there is no opportunity for leakage between the fresh and stale air streams. Moreover, since both valve members are mounted on a common shaft, construction of the valves is considerably simplified and a small servo motor can be used to drive the valve means.

The present invention also integrates the heating and ventilating functions by providing a damper upstream of the ventilator fresh air outlet to the furnace supply elbow, so that the low energy fresh air blower in the ventilator can be active when the high energy furnace blower is inactive without resulting in backflow from the ventilator into the furnace. The damper is biased by gravity to a closed position such that the force of air from the furnace air blower is sufficient to open the damper. The biasing force is controlled by an external counterweight which can be adjusted to ensure that the damper remains closed when the furnace blower is off, and that the furnace blower discharge will open the damper with minimal back pressure.

The present invention thus provides a regenerative bed heat exchanger, comprising an enclosed heat exchange compartment containing an air permeable regenerative heat exchange bed comprising a bed of a heat recovery medium capable of absorbing and releasing heat, for alternately absorbing heat from and releasing heat into an air stream, the bed having opposed air-permeable faces which permit a flow of air through the medium, an air inlet provided with a fresh air inlet port and a stale air inlet port, and an air outlet provided with a fresh air outlet port and a stale air outlet port, the heat exchange bed separating the fresh air inlet port from the stale air inlet port and separating the stale air outlet port from the fresh air outlet port such that a fresh air flow path is created through the fresh air inlet port, through the heat recovery medium and through the fresh air outlet port, and a stale air flow path is created through the stale air inlet port, through the heat recovery medium and through the stale air outlet port, and valve means for selectively simultaneously opening the stale air inlet port and the stale air outlet port while closing the fresh air inlet port and the fresh air outlet port, or simultaneously opening the fresh air inlet port and the fresh air outlet port while closing the stale air inlet port and the stale air outlet port.

The present invention further provides a ventilator comprising two regenerative bed heat exchangers each provided with a regenerative heat exchange bed, comprising a first enclosed heat exchange compartment containing a first air permeable heat exchange bed having a first air inlet provided with a first fresh air inlet port and a first stale air inlet port, and a first air outlet provided with a first air outlet port and a first stale air outlet port; a second enclosed heat exchange compartment containing a second air permeable heat exchange bed having a second air inlet provided with a second fresh air inlet port and a second stale air inlet port, and a second air outlet provided with a second air outlet port and a second stale air outlet port; the first and second heat exchange beds each comprising a bed of a heat recovery medium capable of absorbing and releasing heat, for alternately absorbing heat from and releasing heat into an air stream, each bed having opposed air-permeable faces which permit a flow of air through the medium, the first heat exchange bed separating the first fresh air inlet port from the first stale air inlet port and separating the first stale air outlet port from the first fresh air outlet port and the second heat exchange bed separating the second fresh air inlet port from the second stale air inlet port and separating the second stale air outlet port from the second fresh air outlet port such that a first fresh air flow path is created through the first fresh air inlet port, through the first heat exchange bed and through the first fresh air outlet port, a first stale air flow path is created through the first stale air inlet port, through the first heat exchange bed and through the first stale air outlet port, a second fresh air flow path is created through the second fresh air inlet port, through the second heat exchange bed and through the second fresh air outlet port, and a second stale air flow path is created through the second stale air inlet port, through the second heat exchange bed and through the second stale air outlet port; and valve means for alternately simultaneously opening the first stale air inlet port, the first stale air outlet port, the second fresh air inlet port and the second fresh air outlet port while closing the first fresh air inlet port, the first fresh air outlet port, the second stale air inlet port and the second stale air outlet port, or simultaneously opening the first fresh air inlet port, the first fresh air outlet port, the second stale air inlet port and the second stale air outlet port while closing the first stale air inlet port, the first stale air outlet port, the second fresh air inlet port and the second fresh air outlet port.

The present invention further provides a valve for a heat exchange apparatus comprising an enclosed heat exchange compartment containing an air permeable regenerative heat exchange bed comprising a bed of a heat recovery medium capable of absorbing and releasing heat, for alternately absorbing heat from and releasing heat into an air stream, the bed having opposed air-permeable faces which permit a flow of air through the medium, an air inlet provided with a fresh air inlet port and a stale air inlet port and an air outlet provided with a fresh air outlet port and a stale air outlet port, the heat exchange bed separating the fresh air inlet port from the stale air inlet port and separating the stale air outlet port from the fresh air outlet port such that a fresh air flow path is created through the fresh air inlet port, through the heat recovery medium and through the fresh air outlet port and a stale air flow path is created through the stale air inlet port, through the heat recovery medium and through the stale air outlet port, the valve comprising a rotating inlet valve member having a valve surface interposed between the air inlet partition and the heat exchange bed, comprising an inlet valve opening positioned to come into alignment with the stale air inlet port or the fresh air inlet port, and a rotating outlet valve member having a valve surface interposed between the air outlet and the heat exchange bed, fixed in position relative to the inlet valve member and comprising an outlet valve opening positioned offset circumferentially relative to the inlet valve opening, such that when the inlet valve opening comes into alignment with the stale air inlet port the outlet valve opening comes into alignment with the stale air outlet port, and when the inlet valve opening comes into alignment with the fresh air inlet port the outlet valve opening comes into alignment with the fresh air outlet port.

The present invention further provides an integrated forced air furnace and regenerative heat exchange apparatus, the furnace comprising a furnace blower for discharging a heated air stream into an air supply conduit and the heat exchange apparatus comprising a ventilation blower for discharging a fresh air stream into the air supply conduit, in which the air supply conduit is provided with a damper gravitationally biased to a closed position to prevent backflow of the fresh air stream into the furnace when the ventilation blower is active and the furnace blower is inactive, wherein the biasing of the damper is capable of being overcome under a force of the furnace blower when the furnace blower is active.

BRIEF DESCRIPTION OF THE DRAWINGS

In drawings which illustrate by way of example only a preferred embodiment of the present invention.

DETAILED DESCRIPTION OF THE INVENTION

Figure 1:
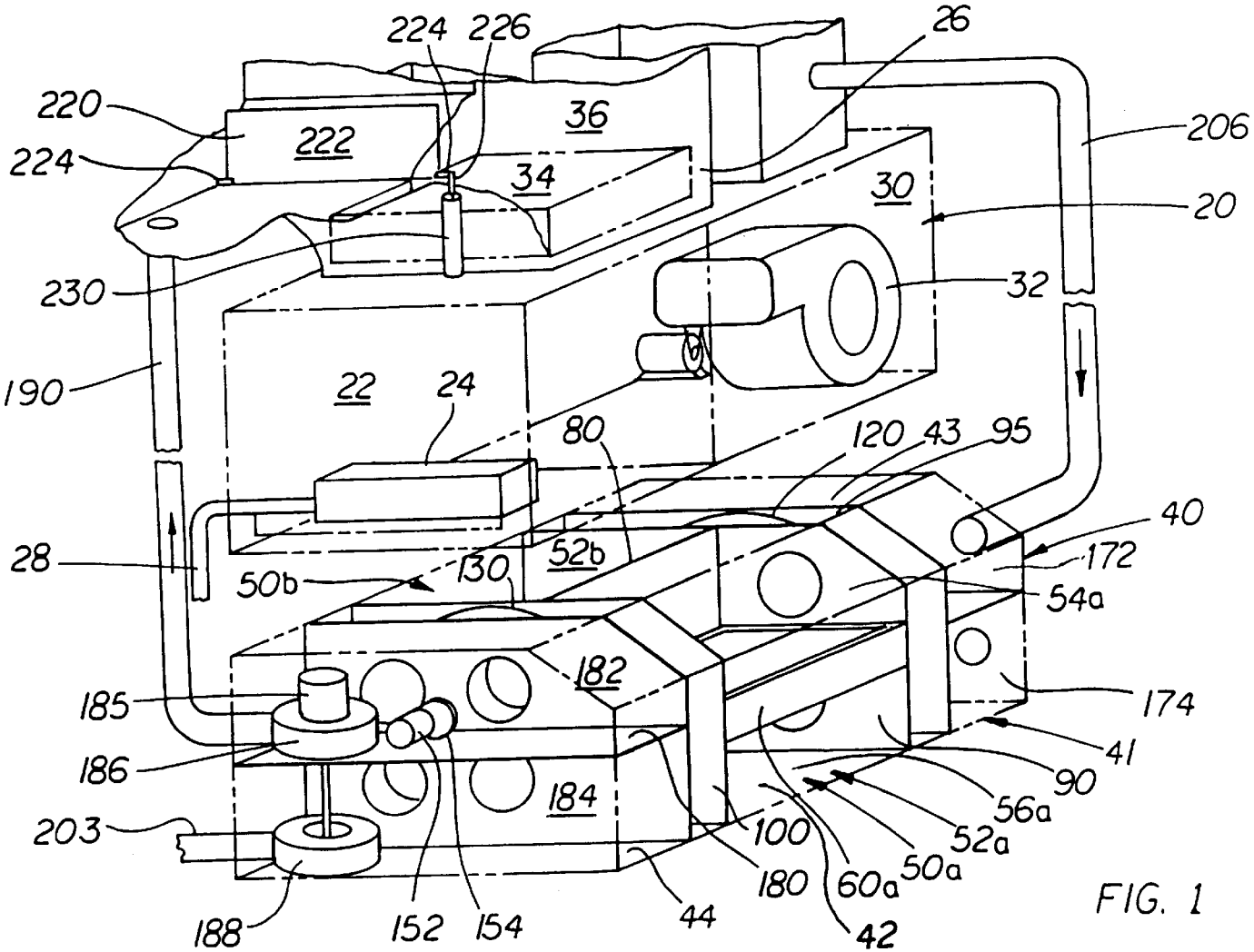
FIG. 1 is a perspective view of the integrated heater and ventilator of the invention.

FIG. 1 illustrates a preferred embodiment the invention, which provides a combustion furnace 20 integrated with a ventilator 40 comprising a pair of regenerative bed heat exchangers 50*a*, 50*b*.

The furnace 20 may be of conventional design, having a heating compartment 22 with combustion means such as a gas burner 24 for heating the air supply to a residence or other building. The heating compartment 22 is in communication with a supply plenum 26 for delivering heated air to the building interior, and flue gases are exhausted through a pipe 28. The furnace 20 may also contain an air conditioner condenser 34 connected to a conventional compressor (not shown) for cooling air within the building during warm weather conditions. A return air compartment 30 contains a high-power blower 32 for drawing return air from within the building and forcing it through the heating compartment 22 where it is heated (or cooled) and forced through the plenum 26 to the supply elbow 36 to heat the building when there is a call for heat.

Although it is beneficial to periodically provide a controlled exchange of stale indoor air and fresh outdoor air, this can be a major source of heat loss and can thus significantly reduce fuel efficiency. In order to ventilate with minimal loss of heat energy during cold weather it is advantageous to heat fresh air drawn from outdoors before introducing it to the building air supply, and to recover heat from stale air before it is exhausted to the outdoors. The present invention accordingly provides a ventilator 40 containing a pair of heat exchangers 50*a*, 50*b*. Each heat exchanger 50*a*, 50*b* contains a regenerative heat exchange bed 60*a*, 60*b*, respectively, and the ventilator alternately switches the heat exchange beds 60*a*, 60*b* between heat recovery and heat release modes as described in U.S. Pat. No. 4,909,307, which is incorporated herein by reference.

The heat exchange beds 60*a*, 60*b* are each housed in an enclosed heat exchange compartment 52*a*, 52*b* contained within the ventilator housing 41. The heat exchange compartments 52*a*, 52*b* are preferably located immediately adjacent to one another, in the embodiment shown isolated by upper and lower partitions 80, 82, which respectively extend from the top panel 43 of the ventilator housing 41 to immediately above the centre of the compartments 52*a*, 52*b*, and from immediately below the centre of the compartments 52*a*, 52*b* to the floor 42 of the ventilator housing 41. This leaves a clearance between the adjacent edges of the partitions 80, 82 for the valve shaft 150, described in detail below. The partitions 80, 82 also extend fully between an air inlet partition 90 and an air outlet partition 100, effectively forming a wall between and thereby isolating the two heat exchange compartments 52*a* and 52*b* so that the air streams flowing through each heat exchanger 50*a*, 50*b* do not intermingle.

Since in the preferred embodiment illustrated the heat exchangers 50*a* and 50*b* are substantially identical, the following description of the heat exchanger 50*a* applies equally to the heat exchanger 50*b*, like parts of the latter being designated by like numerals but with the suffix "b" instead of "a".

Figure 5:
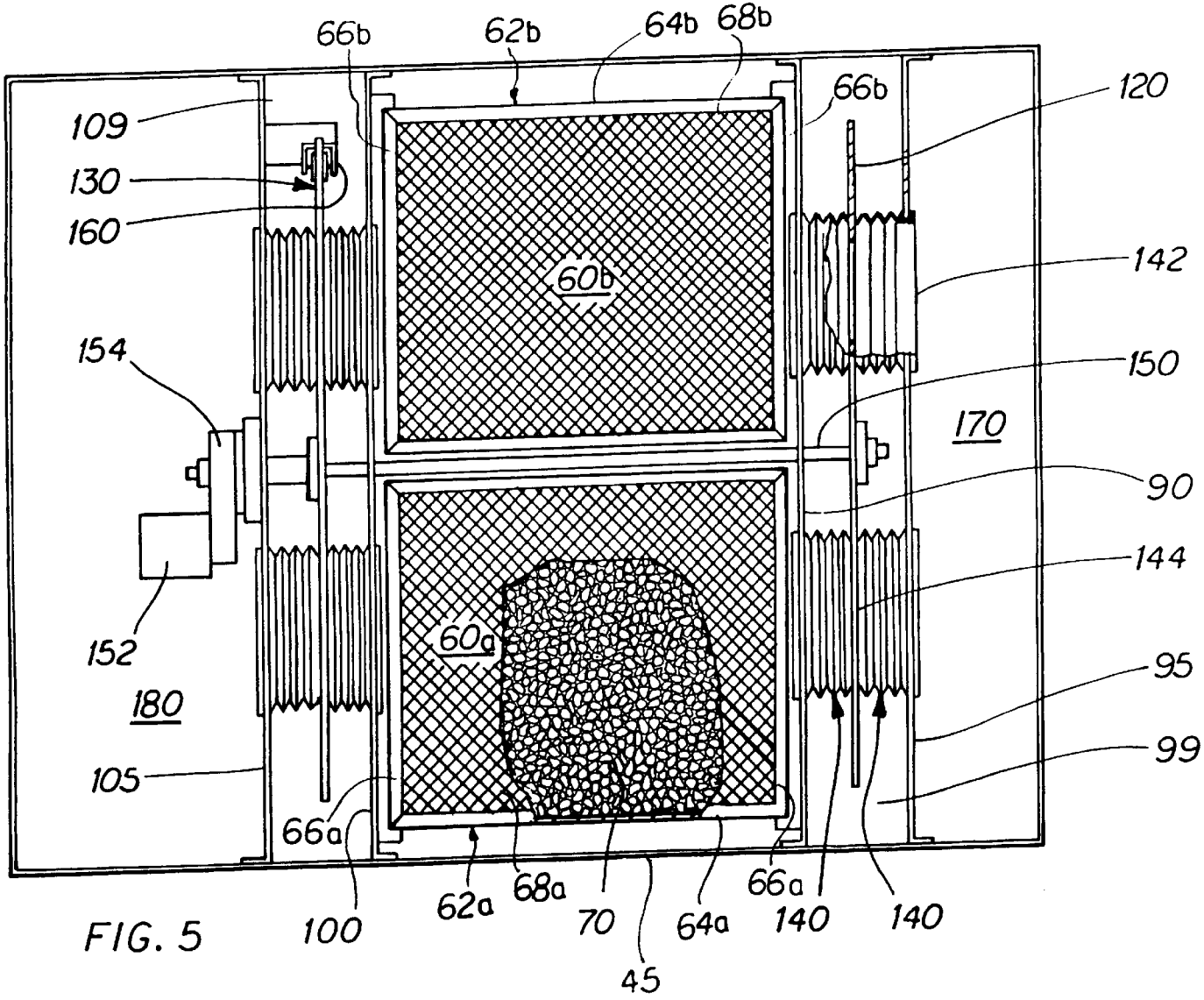
FIG. 5 is a top plan view of the heat exchangers.
Figure 6:
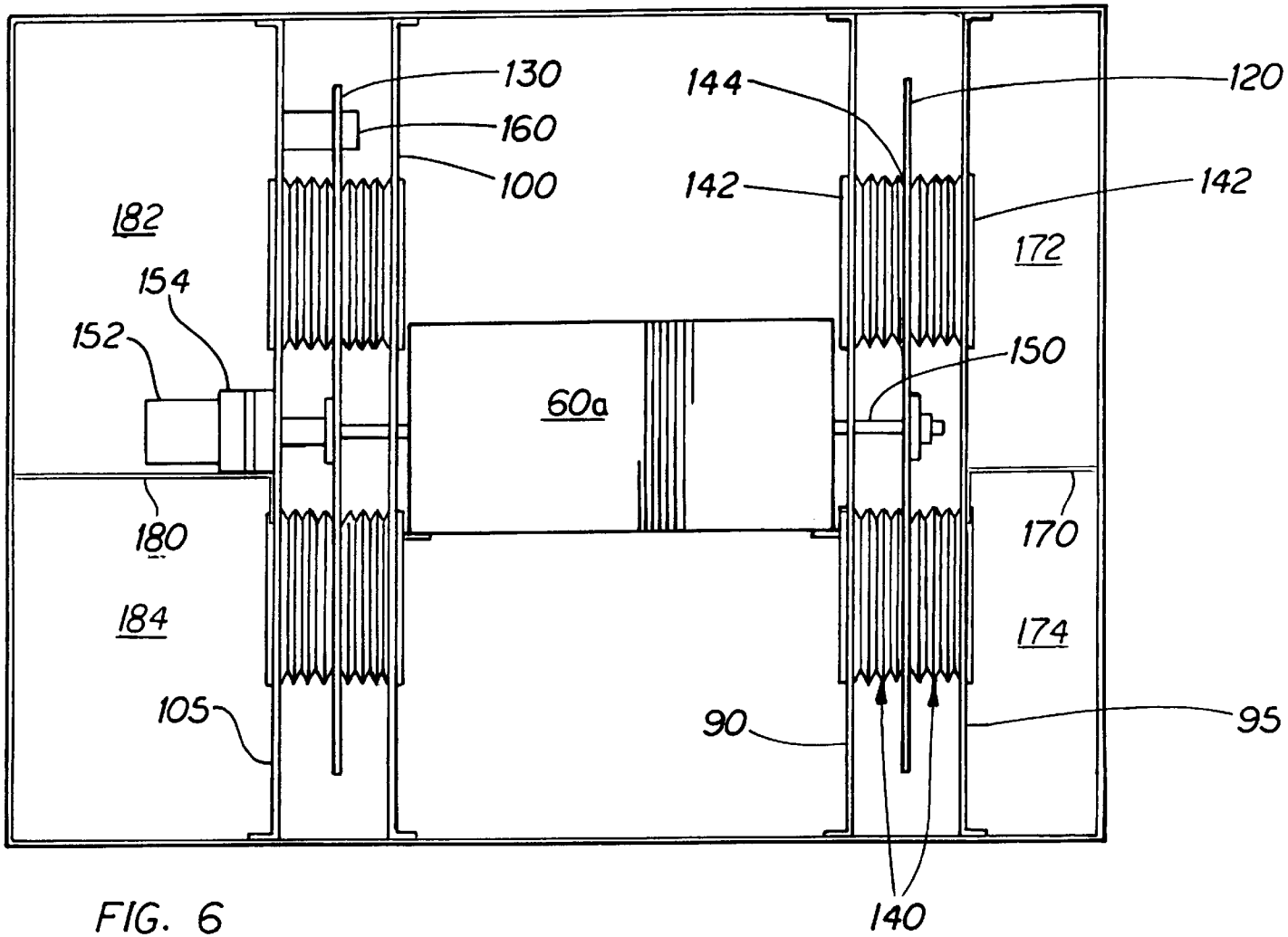
FIG. 6 is a side elevation of the heat exchangers.

As shown in FIG. 5, the heat exchange bed 60*a* consists of a bed housing 62*a* comprising side walls 64*a*, end walls 66*a* and air-permeable faces 68*a*. The housing 62*a* contains a heat recovery medium 70 such as granules, balls or rings composed of ceramic, brick, stone, metal or plastic, preferably ranging in size from 3/16" to 5/16". A wide variety of materials are available for the medium 70, which may be selected according to the heat release/recovery characteristics of the chosen material or mixture and cost considerations. The medium 70 should have a suitable heat capacity and be resistant to decomposition through repeated temperature changes within the normal operating temperature range of the ventilator 40 and exposure to the chemical effects of flue gases. The air-permeable faces 68*a* of the bed housing 62*a* are provided with screens having openings which permit a flow of air through the housing 62*a* but are small enough to retain the heat recovery medium 70.

The heat exchange bed 60*a* extends from the partitions 80, 82 to the side wall 45 of the ventilator housing 41, and fully between the air inlet partition 90 and the air outlet partition 100, such that the heat exchange bed 60*a* effectively partitions the heat exchange compartment 52*a* into two chambers 54*a* and 56*a*.

Figure 4A:
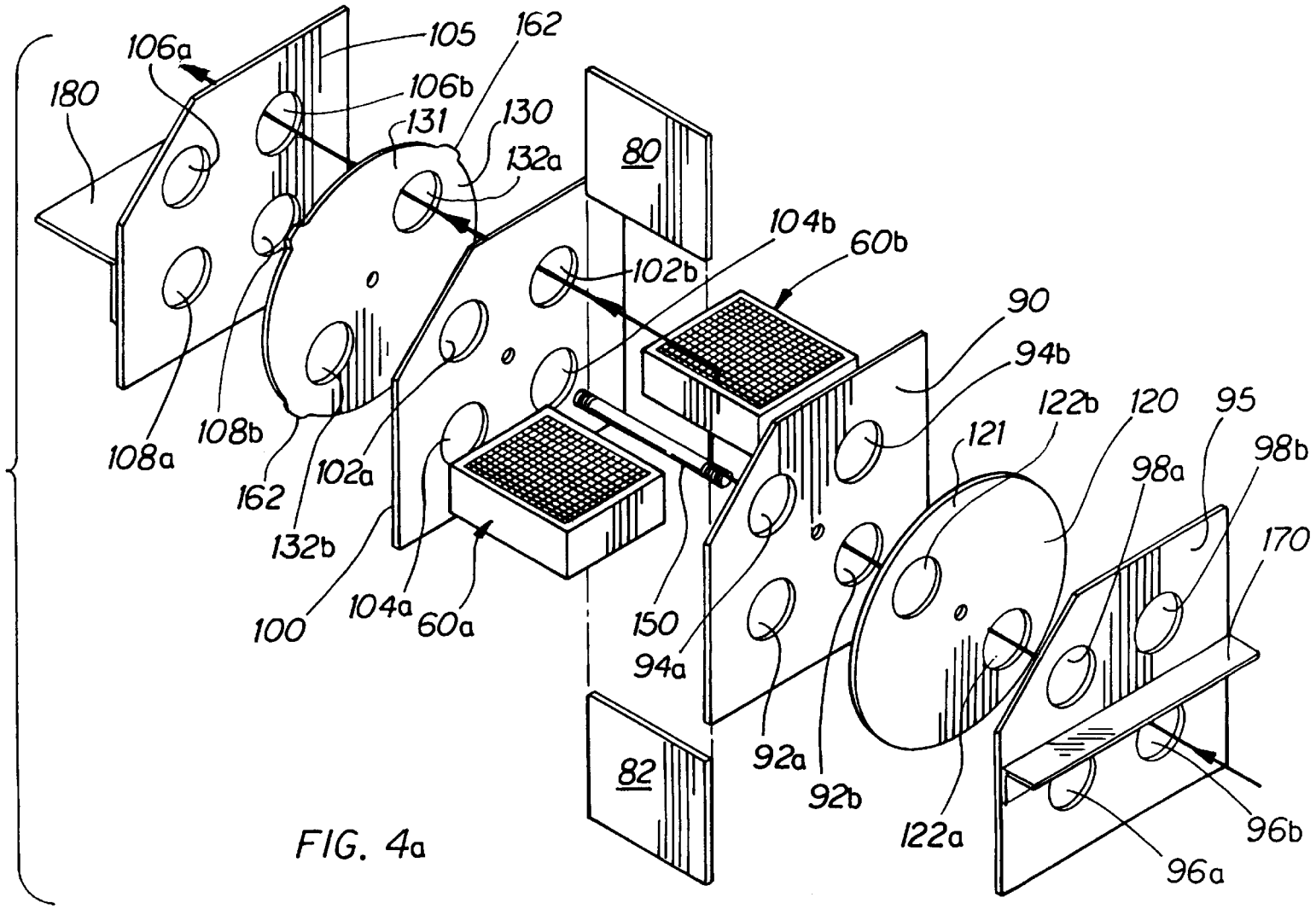
FIG. 4*a* is an exploded view of the heat exchange compartment with the valve discs in the position of FIG. 2, showing the path of fresh air flow through one heat exchanger.
Figure 4B:
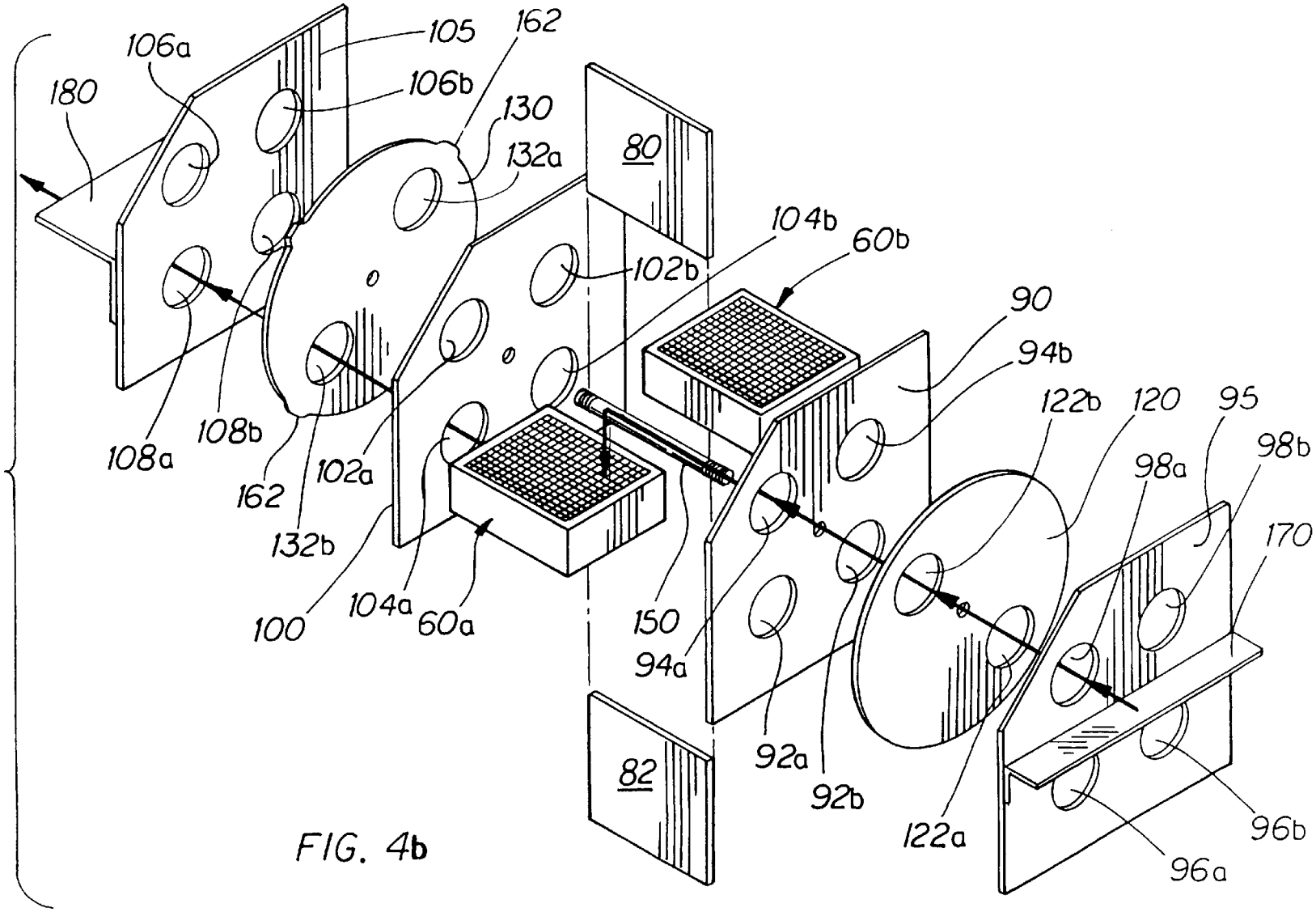
FIG. 4*b* is an exploded view of the heat exchange compartment with the valve discs in the position of FIG. 2, showing the path of stale air flow through the other heat exchanger.
Figure 4C:
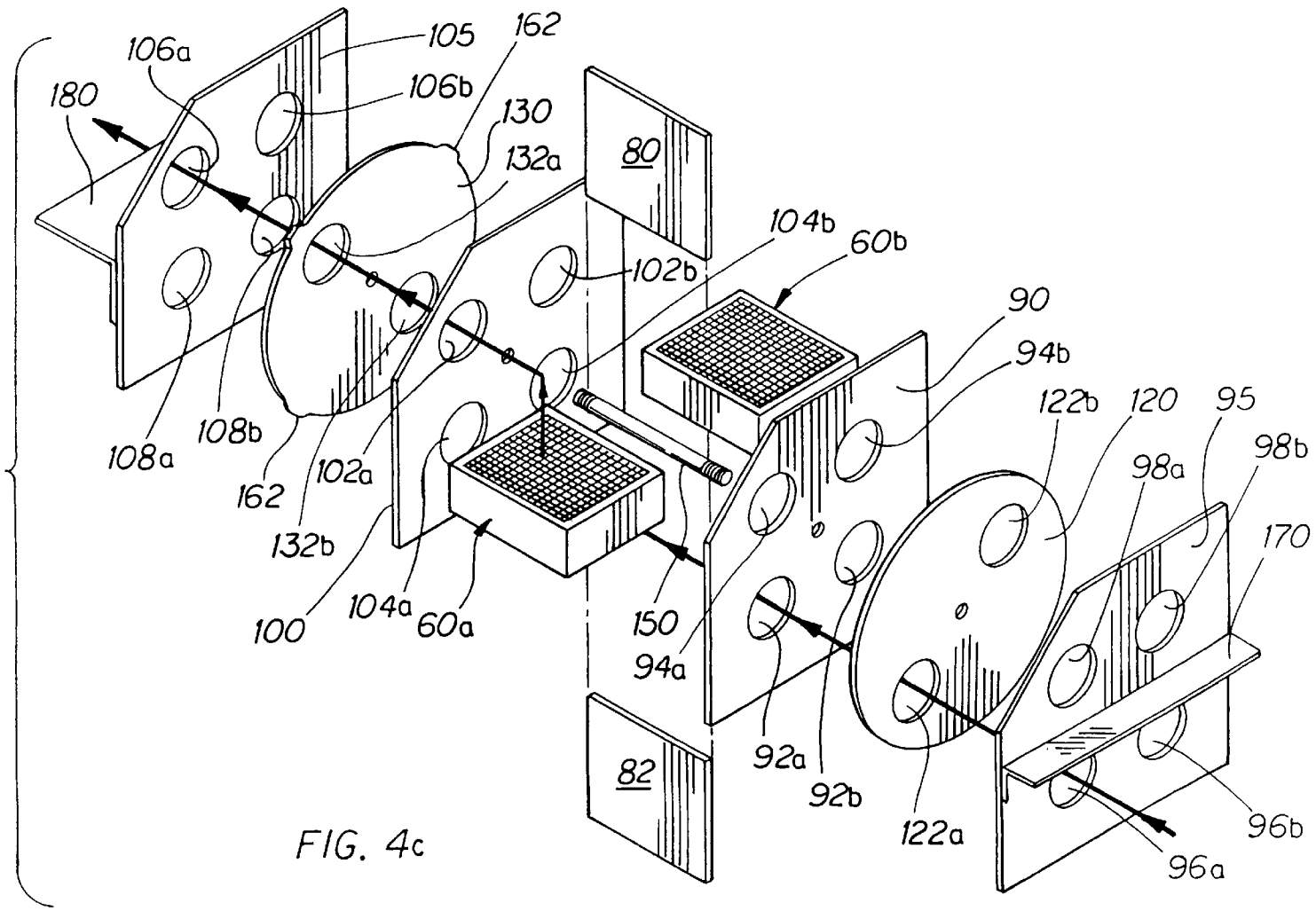
FIG. 4*c* is an exploded view of the heat exchange compartment with the valve discs in the position of FIG. 3, showing the path of fresh air flow through one heat exchanger.
Figure 4D:
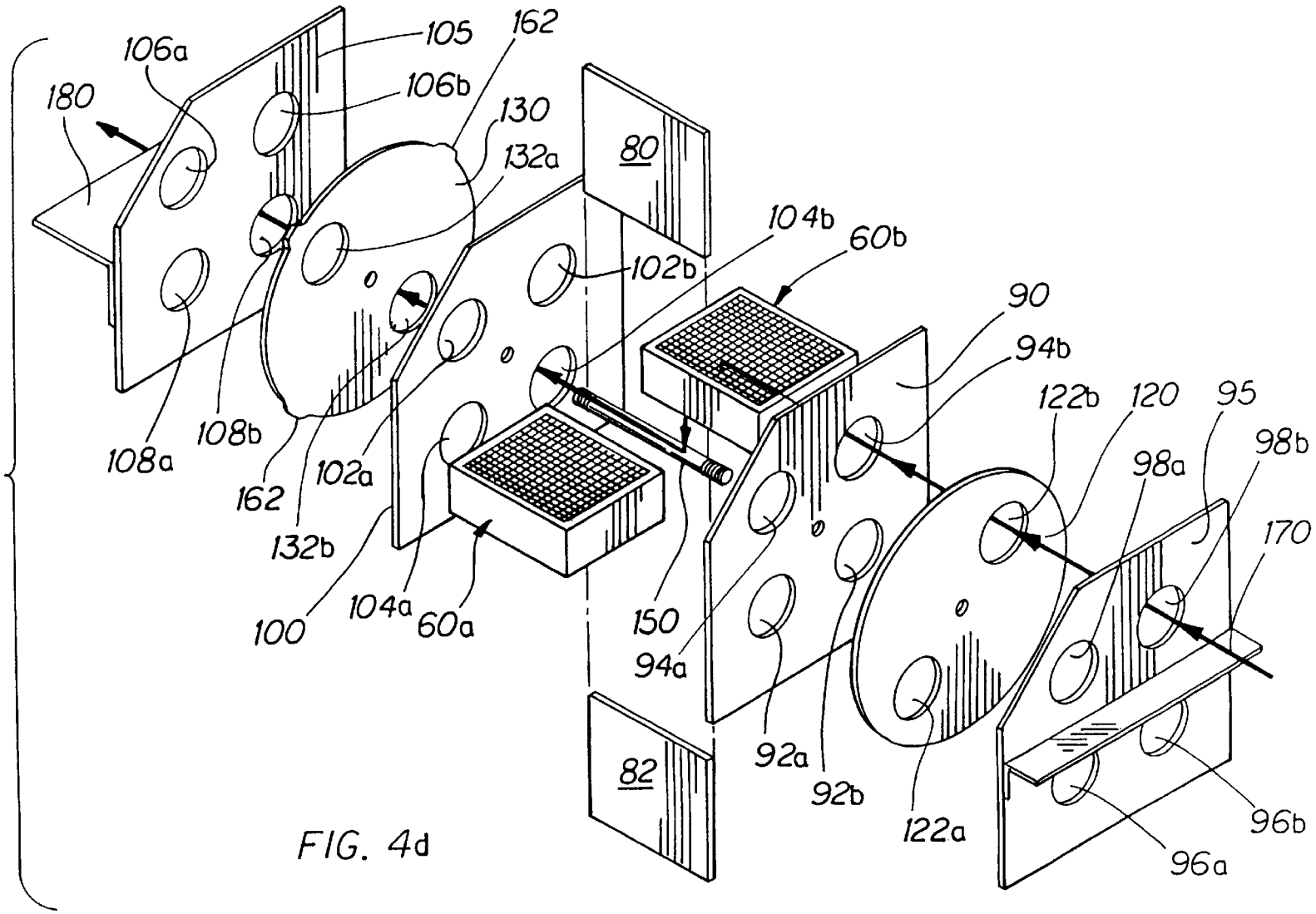
FIG. 4*d* is an exploded view of the heat exchange compartment with the valve discs in the position of FIG. 3, showing the path of stale air flow through the other heat exchanger.

The heat exchange compartment 52*a* is provided with an air inlet, in the preferred embodiment comprising an air inlet partition 90 having a fresh air inlet port 92*a* and a stale air inlet port 94*a*, and an air outlet which in the preferred embodiment comprises an air outlet partition 100 having a fresh air outlet port 102*a* and a stale air outlet port 104*a*. The fresh and stale air outlet ports 102*a*, 104*a* are disposed in inverted relation to the fresh and stale air inlet ports 92*a*, 94*a*. In other words, using the pair of planes in which the air-permeable faces 68*a* of the heat exchange bed 60*a* lie as a reference, at the inlet end of the ventilator 40 the fresh and stale air inlet ports 92*a*, 94*a* are disposed on opposite sides of the pair of planes; at the outlet end of the ventilator 40 the fresh and stale air inlet ports 92*a*, 94*a* are also disposed on opposite sides of the pair of planes but are reversed, or inverted, relative to the fresh and stale air inlet ports 92*a*, 94*a*. The ports 92*a*, 94*a*, 102*a*, 104*a* are thus arranged so that the fresh air inlet port 92*a* is in communication with one chamber 56*a* and the fresh air outlet port 102*a* is in communication with the other chamber 54*a*; conversely, the stale air inlet port 94*a* is in communication with one chamber 54*a* while the stale air outlet port 104*a* is in communication with the other chamber 56*a*. In this fashion, a fresh air stream entering the fresh air inlet port 92*a* must traverse the heat exchange bed 60*a* in order to egress from the fresh air outlet port 102*a*, and a stale air stream entering the stale air inlet port 94*a* must traverse the heat exchange bed 60*a* in order to egress from the stale air outlet port 104*a*. The air-permeable faces 68*a* of the heat exchange bed 60*a* are in direct communication with the chambers 54*a*, 56*a* within the heat exchange compartment 52*a* so that, depending upon the position of the valve means, a fresh air flow path is created through the fresh air inlet port 92*a*, through the heat recovery medium 70 and through the fresh air outlet port 102*a*, as shown by the arrows in FIGS. 4*a* and 4*c*, or a stale air flow path is created through the stale air inlet port 94*a*, through the heat recovery medium 70 and through the stale air outlet port 104*a*, as shown by the arrows in FIGS. 4*b* and 4*d*.

The heat exchanger 50*a* is provided with valve means for selectively opening the fresh air inlet port 92*a* and the fresh air outlet port 102*a* while simultaneously closing the stale air inlet port 94*a* and the stale air outlet port 104*a*, or in the alternate position opening the stale air inlet port 94*a* and the stale air outlet port 104*a* while simultaneously closing the fresh air inlet port 92*a* and the fresh air outlet port 102*a*. In a preferred embodiment the valve means comprises a rotating inlet valve member 120 having a substantially planar valve surface 121 interposed between the air inlet partition 90 and air inlet manifolds 172, 174, and a rotating outlet valve member 130 having a substantially planar valve surface 131 interposed between the air outlet partition 100 and the air outlet manifolds 182, 184.

As seen in FIGS. 4*a* to 4*d*, the inlet valve member 120 comprises a valve opening 122*a* (or 122*b*) positioned so that it can be rotated into alignment with the fresh air inlet port 92*a* or the stale air inlet port 94*a*, and the outlet valve member 130 similarly comprises an outlet valve opening 132*a* (or 132*b*) positioned so that it can be rotated into alignment with the fresh air outlet port 102*a* or the stale air outlet port 104*a*. The valve members 120, 130 are preferably composed of a suitable plastic which is relatively rigid, provides a reasonably smooth valve surface 121, 131, and is generally resistant to expansion and contraction over the normal operating temperature range of the ventilator 40. The valve members 120, 130 may for example be cut from a polyethylene sheet of suitable thickness.

To ensure a constant airtight seal between the inlet and outlet valve openings 122*a*, 122*b* and 132*a*, 132*b* and the respective inlet and outlet ports 92*a*, 94*a*, 102*a*, 104*a*, gasket means is interposed between the valve members 120, 130 and the air inlet and outlet partitions 90, 100. In the preferred embodiment the gasket means, shown in FIG. 5, comprises cylindrical bellows 140 composed of a resilient material such as plastic or rubber, which surround the fresh and stale inlet and outlet ports 92*a*, 94*a*, 102*a*, 104*a* and are affixed to the air inlet and outlet partitions 90, 100 at fixed ends 142. The bellows 140 are mounted in a state of compression, and the free ends 144 of the bellows 140 are compressed against the valve members 120, 130 and slide along the valve surfaces 121, 131 as the valve members 120, 130 are rotated. Thus each inlet and outlet port 92*a*, 94*a*, 102*a*, 104*a* remains closed at any point in the changeover cycle when it is not aligned with an inlet or outlet valve opening 122*a*, 122*b*, or 132*a*, 132*b* respectively.

In the preferred embodiment an inlet valve partition 95, having ports 96*a*, 98*a* in alignment with the inlet ports 92*a*, 94*a* of the air inlet partition 90, is provided between the inlet valve member 120 and the air inlet manifolds 172, 174. Thus, the inlet valve partition 95 together with the air inlet partition 90 and the inlet valve member 120 forms an inlet valve means. Likewise, an outlet valve partition 105, having ports 106*a*, 108*a* in alignment with the outlet ports 102*a*, 104*a* of the air outlet partition 100, is provided between the outlet valve member 130 and the air outlet manifolds 182, 184, which together with the outlet partition 100 and the outlet valve member 130 forms an outlet valve means. In this embodiment resilient bellows 140 surrounding the ports 96*a*, 98*a*, 106*a*, 108*a* are fixed to each valve partition 95, 105 in the manner described above, being compressively mounted against surfaces 123, 134 of the valve members 120, 130, respectively, to prevent leakage between fresh and stale air streams within the air inlet manifolds 172, 174 and the air outlet manifolds 182, 184.

It is possible to omit the valve partitions 95, 105 and/or the inlet and outlet partitions 90, 100. Without the valve partitions 95, 105 it would be necessary to provide gaskets 140 along the edges of the manifold partitions 170, 180, and as long as the the gaskets are wider than the diameters of the inlet and outlet valve openings 122*a*, 132*a* there would be no opportunity for leakage between the fresh and stale air streams as the valve openings 122*a*, 132*a* cycle past the manifold partitions 170, 180. Without the inlet and outlet partitions 90, 100 it would be necessary to provide gaskets along the side edges of the partitions 80, 82 and the ends 66*a* of the heat exchange bed 60*a*; again, as long as the the gaskets are wider than the diameters of the inlet and outlet valve openings 122*a*, 132*a* there would be no opportunity for leakage between the two heat exchange compartments 50*a*, 50*b* as the valve openings 122*a*, 132*a* cycle past the partitions 80, 82. However, in both cases a gasket would have to be provided around the edge of the valve discs 120, 130, to prevent the fresh or stale air streams from flowing around the peripheral edges of the discs 120, 130 and thus bypassing the valve openings. For optimal isolation of the fresh and stale air streams, as in the preferred embodiment illustrated, the inlet and outlet valve means are respectively provided with both inlet and outlet partitions 90, 100 and valve partitions 95, 105.

The inlet valve member 120 and the outlet valve member 130 are preferably mounted on a common valve shaft 150 driven by a motor 152 with a suitable gear train 154, and are fixed in position relative to one another such that the outlet valve opening 132*a* is positioned at substantially 90° relative to the inlet valve opening 122*a*. Thus, when the inlet valve opening 122*a* comes into alignment with the stale air inlet port 94*a*, the outlet valve opening 132*b* simultaneously comes into alignment with the stale air outlet port 104*a*, and at the same time the valve surfaces 124, 133 respectively close off the fresh air inlet port 92*a* and the fresh air outlet port 102*a*. Similarly, when the valve members 120, 130 are rotated approximately 90° to the alternate position, so that the inlet valve opening 122*a* comes into alignment with the fresh air inlet port 92*a*, the outlet valve opening 132*a* simultaneously comes into alignment with the fresh air outlet port 102*a*, and the valve surfaces, 124 133 respectively close off the stale air inlet port 94*a* and the stale air outlet port 104*a*.

The above description of the structure and operation of the heat exchanger 50*a* applies equally to the heat exchanger 50*b*. In the preferred embodiment illustrated the two heat exchangers 50*a*, 50*b* are arranged so that when one heat exchange bed 60*a* is absorbing heat, the other heat exchange bed 60*b* is releasing heat. Accordingly, both heat exchangers 50*a*, 50*b* share common air inlet and air outlet partitions 90, 100, and the fresh and stale air inlet ports 92*a*, 92*b*, 94*a*, 94*b* are distributed on the air inlet partition 90 symmetrically about the rotational axis of the shaft 150, which is mounted through the two heat exchange compartments 52*a*, 52*b* (through the clearance provided between the adjacent edges of partitions 80, 82). The fresh and stale air outlet ports 102*a*, 102*b*, 104*a*, 104*b* are similarly distributed on the air outlet partition 100 symmetrically about the rotational axis of the shaft 150. A pair of inlet valve openings 122*a*, 122*b* are disposed through the inlet valve member 120 symmetrically about the axis of the shaft 150, and a pair of outlet valve openings 132*a*, 132*b* are disposed through the outlet valve member 130 symmetrically about the axis of the shaft 150. In this fashion proper alignment between the inlet and outlet valve openings 122*a*, 122*b* and 132*a*, 132*b*, respectively, and the respective air inlet and air outlet ports for each heat exchange compartment 52*a*, 52*b* is obtained when the valve members 120, 130 are rotated to one of the alternate positions of the valve means.

Figure 7:
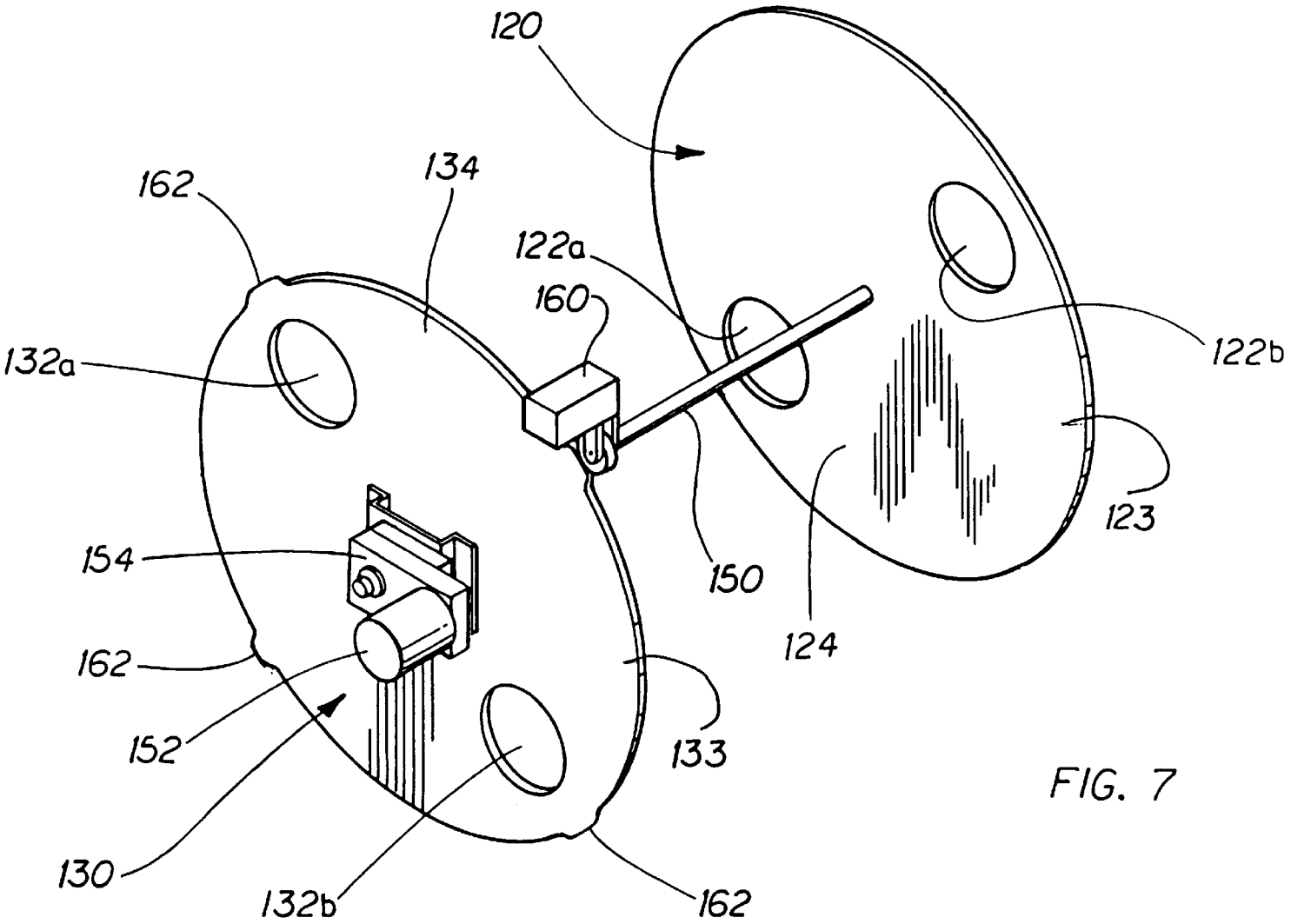
FIG. 7 is a perspective view of the valve assembly.

The angular position of the valve members 120, 130 is controlled by a stationary limit switch 160. The peripheral edge of one of the valve members, as shown in FIG. 5 the outlet valve member 130, is provided with four cam lobes 162, best seen in FIG. 7, which contact the limit switch 160 when the inlet and outlet valve openings 122*a*, 122*b*, 132*a*, 132*b* are directly aligned with the respective inlet and outlet ports 92*a*, 94*b*, 102*a*, 104*b* or 92*b*, 94*a*, 102*b*, 104*a*, at which point the switch 160 arrests rotation of the drive motor 152. When the valve members 120, 130 are signalled to cycle to the next 90° position, switching the heat absorption and release modes between the heat exchange beds 60*a*, 60*b*, the drive motor controller momentarily overrides the limit switch 160 (for example through a relay) until the cam 162 is no longer in contact with the limit switch 160. As the valve members 120, 130 reach the alternate position the second cam 162 contacts the limit switch 160 to arrest rotation of the drive motor 152. Alternatively, a single cam 162 can be formed on the edge of either of the valve members 120 or 130 and a pair of suitably positioned stationary limit switches 160 can be used to arrest the rotation cycle when the valve members 120, 130 are in the correct position.

In the preferred embodiment the inlet valve openings 122*a*, 122*b* and the outlet valve openings 132*a*, 132*b* are disposed on the inlet and outlet valve members 120, 130, respectively, in diametric opposition. Thus, when one inlet valve opening 122*a* is in alignment with, for example, the fresh air inlet port 92*a* of one of the heat exchanger 50*a*, the other inlet valve opening 122*b* is in alignment with the stale air inlet port 94*b* of the other heat exchanger 50*b*. Since the outlet valve openings 132*a*, 132*b* are offset at 90° relative to the inlet valve openings 122*a*, 122*b*, simultaneously one outlet valve opening 132*b* is aligned with the fresh air outlet port 102*a* of the heat exchanger 50*a* and the other outlet valve opening 132*a* is in alignment with the stale air outlet port 104*b* of the heat exchanger 50*b*. The two possible air flow paths for each of the heat exchangers 50*a*, 50*b* are illustrated by the arrows in FIGS. 4*a* to 4*d*.

This configuration provides the advantage that a single inlet manifold partition 170 can be positioned to separate the fresh air inlet ports 92*a*, 92*b* from the stale air inlet ports 94*a*, 94*b* of both heat exchangers 50*a*, 50*b*, so that the ventilator housing 41 forms a manifold enclosure creating separate stale air and fresh air inlet manifolds 172, 174, respectively. This considerably simplifies connection of the heat exchangers 50*a*, 50*b* to the fresh and stale air supplies. Similarly, fresh air and stale air outlet manifolds 182, 184 are created within the ventilator housing 41 by an outlet manifold partition 180 to simplify connection of the heat exchangers 50*a*, 50*b* to the ventilator discharge conduits 190, 192.

In the preferred embodiment the furnace 20 is mounted on top of the ventilator 40, as shown in FIG. 1, and the heat exchangers 50*a*, 50*b* are thus disposed side-by-side, however it will be appreciated that the invention is in no way confined to the particular side-by-side orientation of the heat exchangers 50*a*, 50*b* as shown in the drawings. The ventilator housing 41 is provided with suitable ports for the discharge of fresh air from the fresh air outlet manifold 182 into the furnace supply elbow 36 and the inlet of stale air into the stale air inlet manifold 172. As shown schematically in FIGS. 2 and 3, the fresh air inlet manifold 174 is in communication with the exterior of the building through a port 200. The stale air outlet manifold 184 contains a low energy blower 188 which exhausts stale air to the outdoors through a port 202. The stale air inlet manifold 172 is fed from the furnace return air supply through a duct 206, from the furnace flue 28 through an induced draft blower 27, and optionally by kitchen and bathroom exhaust fans through a stale air duct system 208. Suitable check valves are provided in all stale air return conduits to prevent backflow.

The fresh air outlet manifold 182 contains a low energy fresh air blower 186 which discharges fresh air into the supply elbow 36 of the furnace 20 through a duct 190. The stale air blower 188 and the fresh air blower 186 are preferably mounted in alignment and driven by a single motor 185, as can be seen in FIG. 1, and thus are designed to have the same direction of rotation. Preferably the motor 185 is nested in the eye of the fresh air blower 186, so that heat generated by the motor 185 is absorbed into the fresh air stream and discharged into the building. This both makes use of an additional heat source and extends the life of the motor 185 through cooler operation.

The fresh air blower 186 consumes significantly less energy than the large furnace blower 32 in the furnace air return compartment 30. Thus, in order to allow the ventilator fresh air blower 186 to be active when the furnace blower 32 is off, a damper 220 is provided in the furnace supply elbow 36 upstream of the connection 190 to the discharge of fresh air blower 186.

Figure 8:
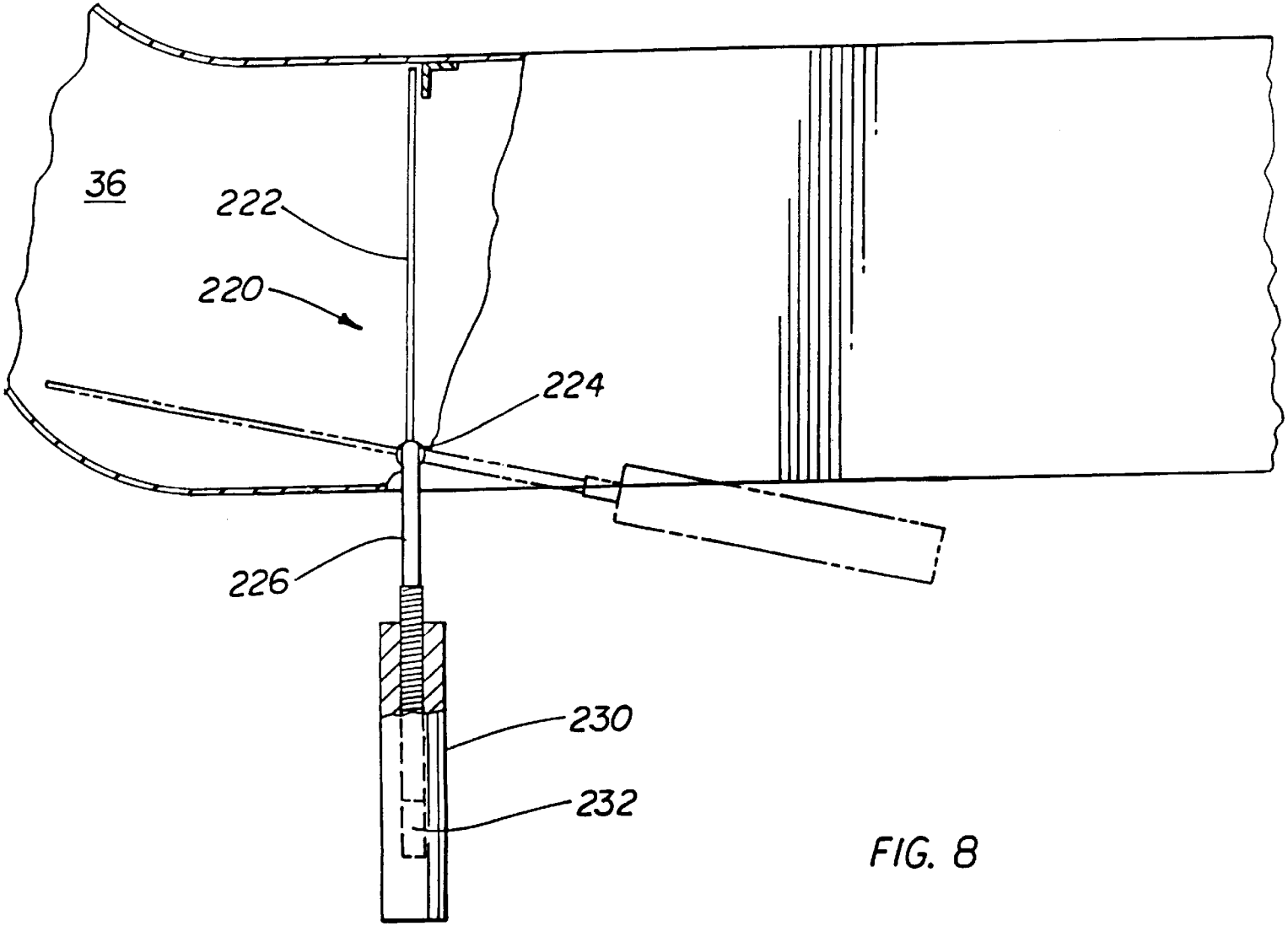
FIG. 8 is a partially cutaway side elevation of a furnace air supply damper according to the invention.

The damper 220, shown in detail in FIG. 8, is pivotally mounted as at hinges 224, and is normally biased to the closed position (shown in solid lines) so that it stays closed whenever the furnace blower 32 is off. However, the damper 220 must be forced open relatively easily under the force of discharge from the furnace blower 32 with minimal resulting back-pressure. To achieve this a counterweight 230 with a threaded hollow core 232 is affixed to a complimentary bolt 226 projecting from the hinge 224 outside of the supply elbow 36, as seen in FIG. 8. When the damper plate 222 is closed, the counterweight 230 is at the low position in its arc of travel. As the damper 220 is opened under the force of air delivered by the furnace blower 32 (shown in phantom lines in FIG. 8), the counterweight 230 rises to the upper position. The force required to open the damper 220 is directly proportional to the distance of the counterweight 230 from the damper hinge 224, which is adjusted by turning the counterweight 230 clockwise or counterclockwise to change its position on the bolt 226.

In the preferred embodiment a number of safety precautions are incorporated in order to ensure that fresh air delivered to the building interior cannot be contaminated by stale air or combustion exhaust. The fresh air stream is preferably maintained at a higher pressure than the stale air stream, so that any inadvertent communication between the two air streams will result in fresh air leaking into the stale air stream, rather than stale air contaminating the fresh air stream. Preferably both the fresh and stale air streams are maintained at pressures below atmospheric pressure, so that any leak in the heater/ventilator system will cause ambient air to be drawn into the system and prevent air within the system from leaking out. As a further safeguard, in a gas furnace the burner control means should operate in conjunction with the valve control means to override any call for heat and disable the gas burner for a short period before and after the valve members 120, 130 are cycled to an alternate position, to clear the heat exchange compartments 50*a*, 50*b* of flue gases during changeover cycles.

As an additional safeguard, pressure sensors may be mounted downstream of both the induced draft blower 27 and the stale air outlet blower 188, to ensure that they are operating at sufficient pressures that flue gases and stale air cannot leak into the fresh air stream. The airflow rate of the discharge from these blowers is typically too low to actuate a commercially available differential pressure switch; this problem can be resolved by constricting the blower discharge conduit, essentially creating a venturi at the blower discharge, and locating the differential pressure switch in the throat of the constriction where the air stream flows at a significantly increased velocity.

Figure 2:
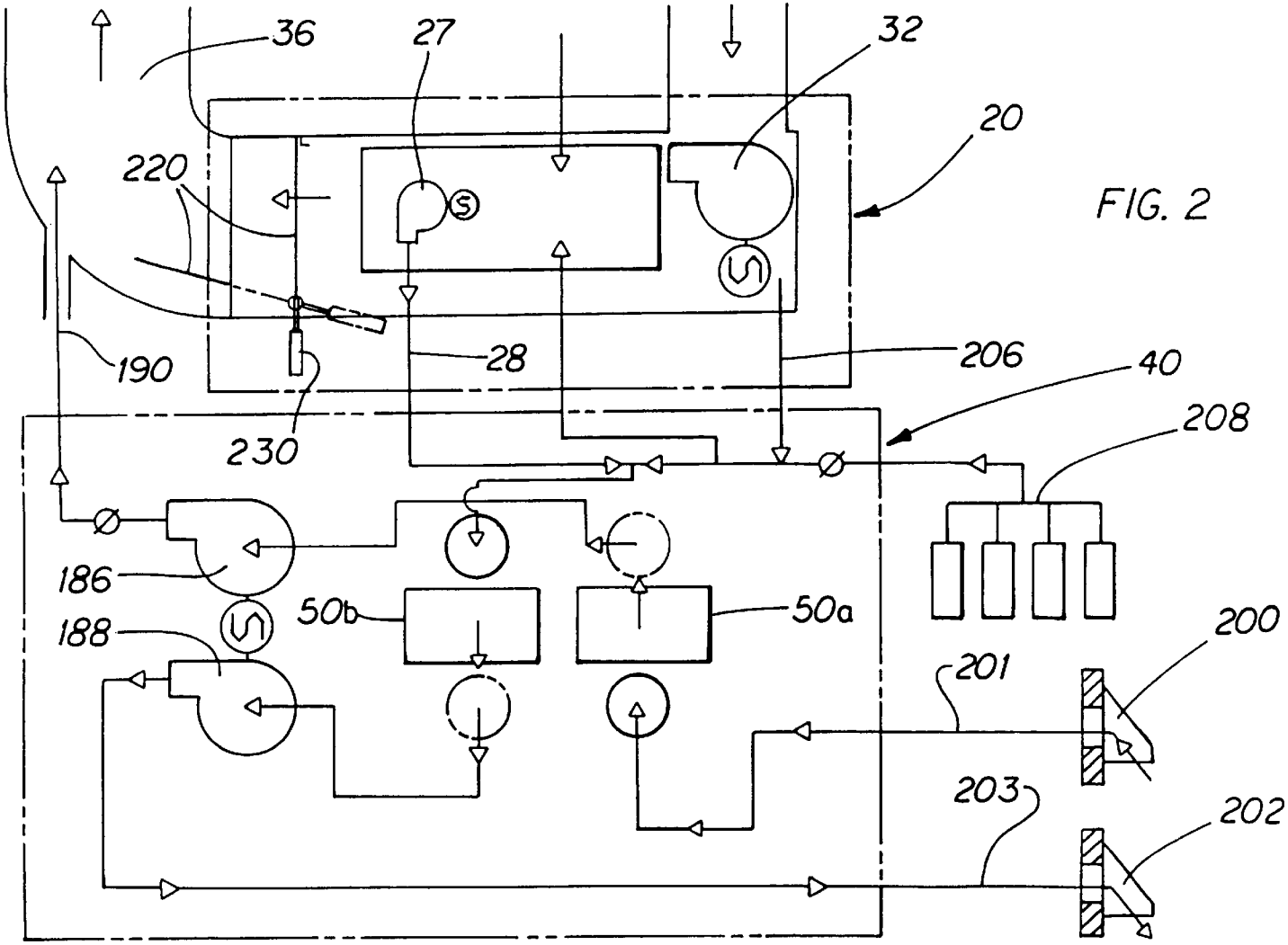
FIG. 2 is a schematic view of the integrated heater-ventilator of the invention showing the direction of flow of the fresh and stale air streams with the first regenerative heat exchange bed in the release mode and the second regenerative heat exchange bed in the recovery mode.

In operation, the valve means is cycled to a first position, shown schematically in FIG. 2, in which one of the heat exchangers 50*a* is in the heat recovery mode so that the stale air inlet and outlet ports 94*a*, 104*a* are open, and the other heat exchanger 50*b* is in the heat release mode, in which the fresh air inlet and outlet ports 92*b*, 102*b* are open. The fresh air blower 186 draws fresh air from outdoors through the port 200 and conduit 201 and into the heat exchanger 50*a* and discharges it to the furnace supply elbow 36 through duct 190, and the stale air blower 188 draws stale air from the furnace air return 32 through duct 206, from the furnace flue gas discharge pipe 28 and optionally from bathroom and kitchen ventilator ducts 208 into the heat exchanger 50*b*, and discharges it to the outdoors through the conduit 203 and port 202. The furnace 20 may be on or off at any time during this process.

Figure 3:
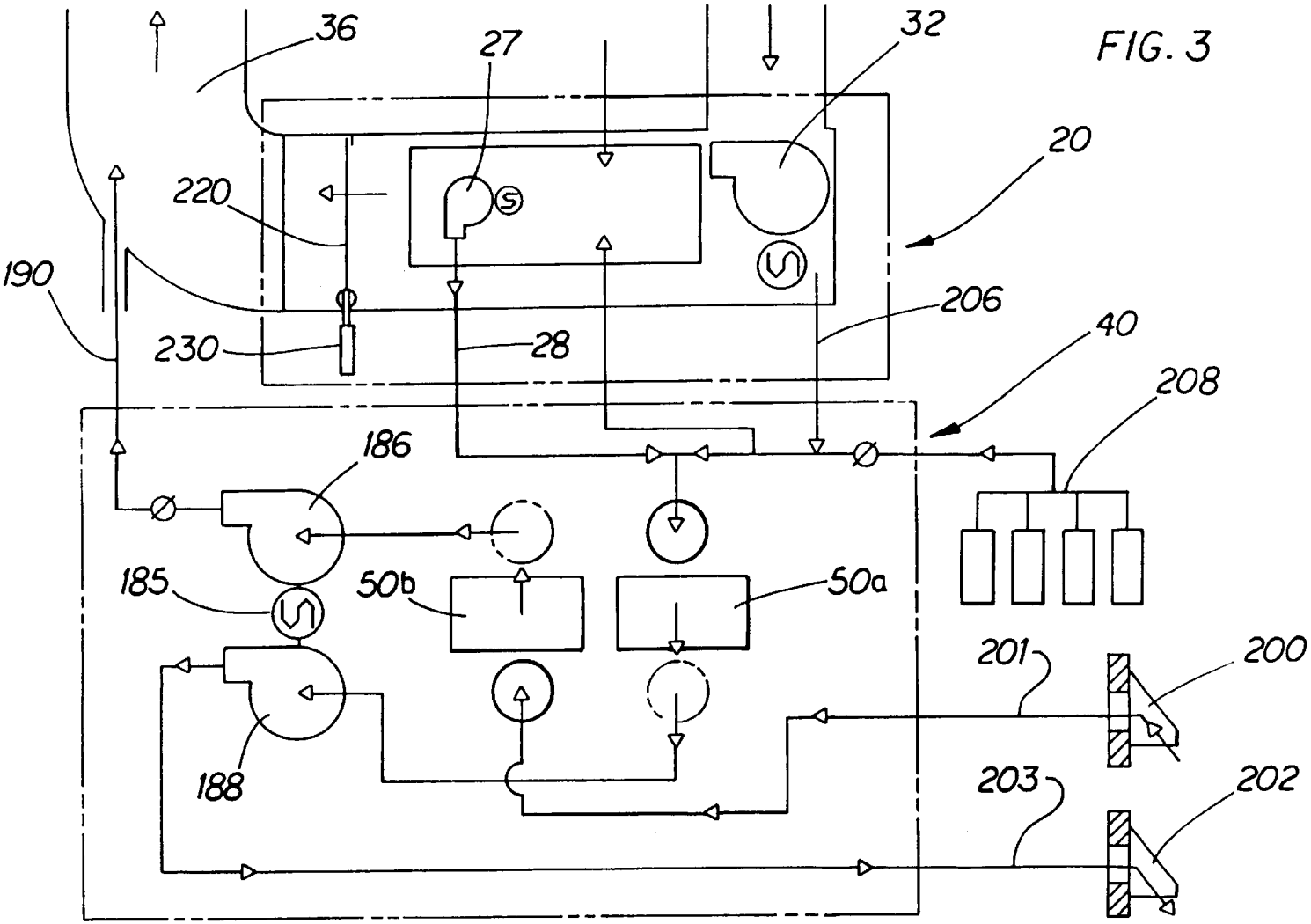
FIG. 3 is a schematic view of the integrated heater-ventilator of the invention showing the direction of flow of the fresh and stale air streams with the second regenerative heat exchange bed in the release mode and the first regenerative heat exchange bed in the recovery mode.

When a timer, thermostat or humidity sensor connected to the valve control means (not shown) determines that it is time to cycle to the alternate setting, shown in FIG. 3, in which the heat exchanger 50*b*is in the heat recovery mode and the other heat exchanger 50*a* is in the heat release mode, the limit switch override is momentarily activated to activate the drive motor 152 and rotate the valve members 120, 130 to the next 90° position. The cam 162 rotates away from the limit switch 160 and the drive motor 152 continues to rotate the shaft 150 until another cam 162 contacts the limit switch 160, arresting rotation of the drive motor 152. When the control means signals the drive motor 152 to cycle the valve members 120, 130 back to the first position, this process repeats with the motor 152 continuing in the same direction (in the embodiment shown with four cams 162 provided around the edge of the valve disc 130), or alternatively reversing direction (in which case two cams 162, positioned at the limit of travel of the valve members 120, 130 in each direction, will be sufficient).

The fresh air blower 186 may be operational even if the furnace blower 32 is inactive when there is no call for heat or air conditioning, because the damper 220 will ensure that the fresh air blower 186 discharge to the furnace supply elbow 36 does not flow into the furnace 20. When the furnace blower 32 switches on, the discharge forces the damper plate 222 open and maintains it open until the furnace blower 32 is switched off, at which point the counterweight 230 forces the damper plate 222 closed again.

A preferred embodiment of the invention having thus been described by way of example only, it will be apparent to those skilled in the art that certain modifications and variations may be made without departing from the scope of the invention. All such modifications and variations are included as fall within the scope of the appended claims.

We claim:

1. A regenerative bed heat exchanger, comprising an enclosed heat exchange compartment containing an air permeable regenerative heat exchange bed comprising a bed of a heat recovery medium capable of absorbing and releasing heat, for alternately absorbing heat from and releasing heat into an air stream, the bed having opposed air-permeable faces which permit a flow of air through the medium, an air inlet provided with a fresh air inlet port and a stale air inlet port, and an air outlet provided with a fresh air outlet port and a stale air outlet port, the heat exchange bed separating the fresh air inlet port from the stale air inlet port and separating the stale air outlet port from the fresh air outlet port such that a fresh air flow path is created through the fresh air inlet port, through the heat recovery medium and through the fresh air outlet port, and a stale air flow path is created through the stale air inlet port, through the heat recovery medium and through the stale air outlet port, and valve means for selectively simultaneously opening the stale air inlet port and the stale air outlet port while closing the fresh air inlet port and the fresh air outlet port, or simultaneously opening the fresh air inlet port and the fresh air outlet port while closing the stale air inlet port and the stale air outlet port, wherein the valve means comprises a rotating inlet valve member having a valve surface interposed between the air inlet and the heat exchange bed, comprising an inlet valve opening positioned to come into alignment with the stale air inlet port or the fresh air inlet port, and a rotating outlet valve member having a valve surface interposed between the air outlet and the heat exchange bed, fixed in position relative to the inlet valve member and comprising an outlet valve opening, such that when the inlet valve opening comes into alignment with the stale air inlet port the outlet valve opening comes into alignment with the stale air outlet port, and when the inlet valve opening comes into alignment with the fresh air inlet port the outlet valve opening comes into alignment with the fresh air outlet port.

2. The heat exchange apparatus of claim 1 wherein the outlet valve opening is positioned at substantially 90 degrees relative to the inlet valve opening.

3. The heat exchange apparatus of claim 1 wherein the inlet and outlet valve members are fixed on a common shaft and driven by rotating drive means.

4. The heat exchange apparatus of claim 1 wherein the fresh air inlet port and the stale air inlet port are disposed through an air inlet partition and the fresh air outlet port and the stale air outlet port are disposed through an air outlet partition.

5. The heat exchange apparatus of claim 4 wherein gasket means is interposed between the inlet valve member and one or more of the fresh and stale inlet ports in the air inlet partition, and between the outlet valve member and one or more of the fresh and stale outlet ports in the air outlet partition.

6. The heat exchange apparatus of claim 5 wherein the gasket means comprises a resilient bellows surrounding one or more of the fresh and stale inlet ports in the air inlet partition and the fresh and stale outlet ports in the air outlet partition.

7. The heat exchange apparatus of claim 1 wherein at least one of the inlet or outlet valve members is substantially disc-shaped and has a peripheral edge provided with one or more cams cooperating with one or more limit switches to signal a drive means to arrest rotation of the valve members when the valve openings come into alignment with selected ports, wherein a drive means includes means for overriding the one or more limit switches to commence rotation of the valve members to cycle the valve members to an alternate position.

8. The heat exchange apparatus of claim 1 in which the fresh air stream and the stale air stream are both maintained at sub-atmospheric pressures.

9. The heat exchange apparatus of claim 6 in which the fresh air stream and the stale air stream are both maintained at sub-atmospheric pressures.

10. A forced air furnace having a heated air supply stream in communication with the fresh air outlet port of the heat exchange apparatus of claim 1.

11. The forced air furnace of claim 10 having a combustion gas exhaust stream outlet in communication with the stale air inlet port of the heat exchange apparatus.

12. The forced air furnace of claim 10 in which a conduit for the heated air supply stream is provided with a damper gravitationally biased to a closed position and capable of being opened under a force of the heated air stream.

13. The forced air furnace of claim 12 in which the damper is provided with an adjustable counterweight exterior to the conduit for adjusting the gravitational force biasing the damper to the closed position.

14. A ventilator comprising two regenerative bed heat exchangers each provided with a regenerative heat exchange bed, comprising a first enclosed heat exchange compartment containing a first air permeable heat exchange bed having a first air inlet provided with a first fresh air inlet port and a first stale air inlet port, and a first air outlet provided with a first air outlet port and a first stale air outlet port, a second enclosed heat exchange compartment containing a second air permeable heat exchange bed having a second air inlet provided with a second fresh air inlet port and a second stale air inlet port, and a second air outlet provided with a second air outlet port and a second stale air outlet port, the first and second heat exchange beds each comprising a bed of a heat recovery medium capable of absorbing and releasing heat, for alternately absorbing heat from and releasing heat into an air stream, each bed having opposed air-permeable faces which permit a flow of air through the medium, the first heat exchange bed separating the first fresh air inlet port from the first stale air inlet port and separating the first stale air outlet port from the first fresh air outlet port and the second heat exchange bed separating the second fresh air inlet port from the second stale air inlet port and separating the second stale air outlet port from the second fresh air outlet port such that a first fresh air flow path is created through the first fresh air inlet port, through the first heat exchange bed and through the first fresh air outlet port, a first stale air flow path is created through the first stale air inlet port, through the first heat exchange bed and through the first stale air outlet port, a second fresh air flow path is created through the second fresh air inlet port, through the second heat exchange bed and through the second fresh air outlet port, and a second stale air flow path is created through the second stale air inlet port, through the second heat exchange bed and through the second stale air outlet port, and valve means for alternately simultaneously opening the first stale air inlet port, the first stale air outlet port, the second fresh air inlet port and the second fresh air outlet port while closing the first fresh air inlet port, the first fresh air outlet port, the second stale air inlet port and the second stale air outlet port, or simultaneously opening the first fresh air inlet port, the first fresh air outlet port, the second stale air inlet port and the second stale air outlet port while closing the first stale air inlet port, the first stale air outlet port, the second fresh air inlet port and the second fresh air outlet port, wherein the valve means comprises a rotating inlet valve member having a valve surface interposed between the first air inlet and the first heat exchange bed and between the second air inlet and the second heat exchange bed, comprising a first inlet valve opening positioned to come into alignment with the first fresh inlet port when a second inlet valve opening comes into alignment with the second stale air inlet port, and a rotating outlet valve member having a valve surface interposed between the first air outlet and the first heat exchange bed and between the second air outlet and the second heat exchange bed, fixed in position relative to the inlet valve member and comprising a first outlet valve opening positioned to come into alignment with the first fresh outlet port when a second outlet valve opening comes into alignment with the second stale air outlet port, such that when the first inlet valve opening comes into alignment with the first stale air inlet port the first outlet valve opening comes into alignment with the first stale air outlet port, and when first the inlet valve opening comes into alignment with the fresh air inlet port the first outlet valve opening comes into alignment with the fresh air outlet port.

15. The heat exchange apparatus of claim 14 wherein the first outlet valve opening is positioned at substantially 90 degrees relative to the first inlet valve opening and the second outlet valve opening is positioned at substantially 90 degrees relative to the second inlet valve opening.

16. The heat exchange apparatus of claim 14 wherein the inlet and outlet valve members are fixed on a common shaft and driven by rotating drive means.

17. The heat exchange apparatus of claim 14 wherein the fresh air inlet ports and the stale air inlet ports are disposed through an air inlet partition and the fresh air outlet ports and the stale air outlet ports are disposed through an air outlet partition.

18. The heat exchange apparatus of claim 17 wherein gasket means is interposed between the inlet valve member and one or more of the fresh and stale inlet ports in the air inlet partition, and between the outlet valve member and one or more of the fresh and stale outlet ports in the air outlet partition.

19. The heat exchange apparatus of claim 18 wherein the gasket means comprises a resilient bellows surrounding one or more of the fresh and stale inlet ports in the air inlet partition and the fresh and stale outlet ports in the air outlet partition.

20. The heat exchange apparatus of claim 14 wherein at least one of the inlet or outlet valve members is substantially disc-shaped and has a peripheral edge provided with one or more cams cooperating with one or more limit switches to signal a drive means to arrest rotation of the valve members when the valve openings come into alignment with selected ports, wherein a drive means includes means for overriding the one or more limit switches to commence rotation of the valve members to cycle the valve members to an alternate position.

21. A forced air furnace having a heated air supply stream in communication with the fresh air outlet port of the heat exchange apparatus of claim 14.

22. The forced air furnace of claim 21 having a combustion gas exhaust stream outlet in communication with the stale air inlet port of the heat exchange apparatus.

23. A valve for a heat exchange apparatus comprising an enclosed heat exchange compartment containing an air permeable regenerative heat exchange bed comprising a bed of a heat recovery medium capable of absorbing and releasing heat, for alternately absorbing heat from and releasing heat into an air stream, the bed having air-permeable faces which permit a flow of air through the medium, an air inlet provided with a fresh air inlet port and a stale air inlet port and an air outlet provided with a fresh air outlet port and a stale air outlet port, the heat exchange bed separating the fresh air inlet port from the stale air inlet port and separating the stale air outlet port from the fresh air outlet port such that a fresh air flow path is created through the fresh air inlet port, through the heat recovery medium and through the fresh air outlet port and a stale air flow path is created through the stale air inlet port, through the heat recovery medium and through the stale air outlet port, the valve comprising a rotating inlet valve member having a valve surface interposed between the air inlet and the heat exchange bed, comprising an inlet valve opening positioned to come into alignment with the stale air inlet port or the fresh air inlet port, and a rotating outlet valve member having a valve surface interposed between the air outlet and the heat exchange bed, fixed in position relative to the inlet valve member and comprising an outlet valve opening offset circumferentially relative to the inlet valve opening, such that when the inlet valve opening comes into alignment with the stale air inlet port the outlet valve opening comes into alignment with the stale air outlet port, and when the inlet valve opening comes into alignment with the fresh air inlet port the outlet valve opening comes into alignment with the fresh air outlet port.

24. The valve of claim 23 wherein the outlet valve opening is positioned at substantially 90 degrees relative to the inlet valve opening.

25. The valve of claim 23 wherein the inlet and outlet valve members are fixed on a common shaft and driven by rotating drive means.

26. The valve of claim 23 wherein at least one of the inlet or outlet valve members is substantially disc-shaped and has a peripheral edge provided with one or more cams cooperating with one or more limit switches to signal a drive means to arrest rotation of the valve members when the valve openings come into alignment with selected ports, wherein a drive means includes means for overriding the one or more limit switches to commence rotation of the valve members to cycle the valve members to an alternate position.

* * * * *